US011131145B2

(12) United States Patent
Kivelä et al.

(10) Patent No.: US 11,131,145 B2
(45) Date of Patent: Sep. 28, 2021

(54) DRILLING BOOM AND ROCK DRILLING RIG

(71) Applicant: SANDVIK MINING AND CONSTRUCTION OY, Tampere (FI)

(72) Inventors: Tuomo Kivelä, Tampere (FI); Sirpa Launis, Tampere (FI); Jussi Puura, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 140 days.

(21) Appl. No.: 16/531,520

(22) Filed: Aug. 5, 2019

(65) Prior Publication Data

US 2019/0352968 A1 Nov. 21, 2019

(30) Foreign Application Priority Data

Apr. 30, 2018 (EP) ..... 18170127

(51) Int. Cl.
*E21B 7/02* (2006.01)

(52) U.S. Cl.
CPC ..... *E21B 7/025* (2013.01)

(58) Field of Classification Search
CPC ..... E21B 7/02; E21B 6/04; E21B 19/086
USPC ..... 173/179
See application file for complete search history.

(56) References Cited

U.S. PATENT DOCUMENTS

| | | | | |
|---|---|---|---|---|
| 4,364,540 | A | 12/1982 | Montabert | |
| 5,937,952 | A | 8/1999 | Bigoney | |
| 2014/0110168 | A1* | 4/2014 | Pursimo | E21B 7/022 175/24 |
| 2016/0123146 | A1* | 5/2016 | Makela | G05D 1/024 701/50 |

FOREIGN PATENT DOCUMENTS

| | | | | |
|---|---|---|---|---|
| EP | 3159474 | A1 * | 4/2017 | E21B 6/00 |
| EP | 3159474 | A1 | 4/2017 | |
| GB | 2189724 | B | 5/1990 | |
| WO | 2007073327 | A1 | 6/2007 | |
| WO | WO-2007073327 | A1 * | 6/2007 | E21B 7/025 |
| WO | 2007100287 | A1 | 9/2007 | |

* cited by examiner

*Primary Examiner* — Nathaniel C Chukwurah
(74) *Attorney, Agent, or Firm* — Corinne R. Gorski

(57) ABSTRACT

A drilling boom and rock drilling rig. The drilling boom includes a basic boom part, a distal end of which is provided with a front joint assembly of a wrist. The wrist connects a feed beam assembly to the basic boom part. The wrist has three joints, which are a roll-over joint, a feed tilt joint and a feed swing joint. The order of the joints of the wrist is optimized when the joints are in the mentioned order. The rock drilling rig is provided with one or more such drilling booms provided with face drilling units or bolting heads.

12 Claims, 3 Drawing Sheets

RO-T-S2

DRILLING BOOM AND ROCK DRILLING RIG

RELATED APPLICATION DATA

This application claims priority under 35 U.S.C. § 119 to EP Patent Application No. 18170127.7, filed on Apr. 30, 2018, which the entirety thereof is incorporated herein by reference.

TECHNICAL FIELD

The present invention relates to a drilling boom of a rock drilling rig. The drilling boom is provided with a feed beam assembly including a rock drilling machine for drilling blast holes or bolting holes to rock surfaces. The boom has several joints allowing the rock drilling machine to be positioned into planned drilling positions. The invention further relates to a rock drilling rig.

BACKGROUND

In mines and at other work sites different type of rock drilling rigs are used. The rock drilling rigs are provided with one or more booms and rock drilling units are arranged at distal ends of the booms. The rock drilling unit includes a feed beam along which a rock drilling machine is configured to be moved during the drilling procedure. The drilling boom includes several joints allowing the rock drilling machine to be positioned to a desired drilling point for drilling drill holes for blasting or support purposes. However, the present drilling booms contain some disadvantages regarding their kinematics and ability to reach the desired drilling positions.

SUMMARY

An object of the invention is to provide a novel and improved drilling boom and a rock drilling rig equipped with such drilling boom.

The drilling boom of a rock drilling rig includes an elongated basic boom part having a first end, which is connectable movably to a carrier of the rock drilling rig and a distal second end. A feed beam assembly includes a feed beam for supporting a rock drilling machine, which feed beam assembly is located at the second end of the basic boom part. A front joint arrangement, which is located between the second end of the basic boom part and the feed beam assembly, comprises three successive and proximate front joints, a first front joint connected to the basic boom part, a third front joint connected to the feed beam assembly and a second front joint being located between the first and third joint. Several boom actuators are arranged for moving the drilling boom and the feed beam assembly. The first front joint is a roll-over joint, the turning axis of which is parallel to longitudinal axis of the basic boom part. The second front joint is a feed tilt joint, the turning axis of which is perpendicular to the turning axis of the roll-over joint. The third front joint is a feed swing joint having a turning axis of which is perpendicular to the turning axis (20) of the feed tilt joint.

The rock drilling rig includes a movable carrier, at least one drilling boom connected movably to the carrier and equipped with a feed beam assembly with a feed beam. A rock drilling machine is supported by the feed beam. The drilling boom includes several boom joints and boom actuators arranged for orientating and positioning a drilling tool are connectable to the rock drilling machine to drilling points at a drilling site. The drilling boom includes the aforementioned front joint arrangement having three successive joints: the roll-over joint, the feed tilt joint and the feed swing joint.

An aspect of the disclosed solution is that the drilling boom includes a basic boom part or arm, which is an elongated object, a first end of which is connectable to a carrier of a rock drilling rig. At a second end of the arm is a front joint arrangement or wrist, which connects a feed beam assembly to the arm. The feed beam assembly may be a face drilling unit or a bolting head and includes at least a feed beam and a rock drilling machine supported on the feed beam. The drilling boom includes several joints and boom actuators for positioning the drilling machine and a drilling tool connectable to it into the planned drilling positions and directions. The wrist has three successive joints, which are located proximate to each other. The joints are arranged in a certain order. A roll-over joint is closest to the arm and is followed by a feed tilt joint. A feed swing joint is closest to the feed beam assembly. Thus, executable movements of the wrist are arranged in an optimized order: roll-over tilt swing.

Another aspect of the disclosed solution is that the front joint assembly or wrist offers improved reach properties. The feed beam assembly, which may be a face drilling unit or a bolting head, may be positioned to challenging blast hole and rock bolt hole positions which are located close to walls, roof and floor of a tunnel or rock cavity.

The wrist also allows new movements and drilling orientations for the face drilling unit and also for the bolter head. The face drilling unit may be directed perpendicular relative to driving direction of the rock drilling rig, whereby it allows drilling crosscuts. Regarding the bolting implementation, the wrist solution allows directing the bolting head also directly forward i.e. in the driving direction, whereby face bolting is also possible. Thanks to these new allowed drilling directions the drilling boom may be utilized in a more effective way.

One additional use enabled by the disclosed wrist is that the face drilling unit and the bolting head may be turned backwards towards a carrier of a drilling jumbo or bolting rig. Then drill bits and other drilling tools, as well as bolting equipment, can be changed and loaded in a convenient and safe manner close to the carrier.

A further aspect of the disclosed solution is that the same front joint assembly or wrist is suitable for face drilling booms intended for tunneling and for fan drilling booms intended for rock bolting. Thus, the present boom and wrist solution may be implemented for carrying face drilling units of tunneling jumbos as well as bolting heads of bolters. This is of course beneficial for the manufacture, service and overall cost-efficiency.

According to an embodiment, the first end of the basic boom part or arm is provided with a rear joint assembly. The assembly includes a swing joint for turning the drilling boom laterally relative to the rock drilling rig. The assembly further includes a lift joint for turning the drilling boom vertically. Thus, the rear joint assembly provides the drilling boom with 2 degrees of freedom (2DOF).

According to an embodiment, the first end of the drilling boom is connected to a mounting plate by means of the rear joint assembly. The mounting plate is provided with fastening elements for fastening it to the carrier of the rock drilling rig. The mounting plate facilitates mounting of the drilling booms to different kind carriers and provides proper support for the drilling boom.

According to an embodiment, between the first and second end of the basic boom part or arm is a linear joint whereby the basic boom part is extendable in the longitudinal direction. The linear joint is the only joint between the first and second end of the basic boom part. In other words, the arm is without any turnable or rotational joints between the first and second end. Thus, the basic boom part may have a relatively simple, durable and light weight structure between its end portions, and still, the joint arrangements at its both ends and the linear zoom joint between them ensure good reach and versatile drilling positions and directions. The arm has totally three degrees of freedom (3DOF), namely the swing, lift and zoom.

According to an embodiment, the turning axis of the roll-over joint is located on the longitudinal axis of the basic boom part. In other words, the turning axis and the longitudinal axis are concentric. Thanks to this embodiment, mounting of the roll-over joint is facilitated and loadings directed to the joint are well controlled.

According to an embodiment, the turning axis of the feed tilt joint is located closer to the roll over joint than the feed swing joint when seen in longitudinal direction of the basic boom part. In other words, the distance between the turning axis of the feed tilt joint and the roll over joint is minor than distance between the turning axis of the feed tilt joint and the feed swing joint. It has been noted that when the feed tilt joint is located proximate to the roll-over joint, improved reach properties can be achieved and collisions between the basic boom part and the feed beam assembly can be better avoided.

According to an embodiment, extensions of the turning axis of the feed tilt joint and the turning axis of the feed swing joint do not cross. Between the feed tilt joint and the feed swing joint may be a physical connecting element, whereby the joints are at a distance from each other.

The distance between the turning axis of the feed tilt joint and the turning axis of the feed swing joint may be 200-300 mm Between the feed tilt joint and the feed swing joint may be a physical connecting element, whereby the joints are at a distance from each other.

According to an embodiment, the feed tilt joint and the feed swing joint are located on opposite sides of the turning axis of the roll-over joint. When the drilling boom is in its normal position the turning axis of the feed tilt joint is located vertically below the turning axis of the roll-over joint.

According to an embodiment, orientation of the feed beam of the feed beam assembly is parallel to the turning axis of the feed swing joint. In other words, drilling direction of the drilling machine supported to the feed beam is parallel to the axis of the last joint of the front joint arrangement. This embodiment is a main implementation in bolting.

According to an embodiment, orientation of the feed beam of the feed beam assembly is perpendicular to the turning axis of the feed swing joint. In other words, drilling direction of the drilling machine supported to the feed beam is perpendicular to axis of the last joint of the front joint arrangement. This embodiment is a main implementation for face drilling jumbos and tunneling.

According to an embodiment, magnitudes of angles of movements of both the roll-over joint and the feed swing joint can be 360°. The feed tilt joint is turnable at least 180°.

According to an embodiment, the structure of the front joint arrangement is symmetric relative to the longitudinal axis of the basic boom part. An advantage of this feature is that the same drilling boom is usable either as a left or a right hand boom of the rock drilling rig.

According to an embodiment, the boom actuators are hydraulic actuators such as hydraulic cylinders and motors. The hydraulic actuators are advantageous since they allow great forces and still provide accurate movement control.

According to an embodiment, boom actuators of the roll-over joint and the feed swing joint are hydraulic motors and the feed tilt joint is moved by means of one or more hydraulic cylinders.

According to an embodiment, the rock drilling machine defines a drill center, which is parallel to the longitudinal direction of the feed beam and on which drill center a drilling tool is rotated during drilling. The drill center has a drill center height which is a transverse distance measured to the turning axis of the roll-over joint. The drill center height is at least 1,000 mm. This provides improved reach properties and prevents collisions between a rear end of the feed beam and the basic boom part.

According to an embodiment, in a bolting implementation the feed beam assembly may include a handling device for moving reinforcing bolts between a bolt storage and drilling axis of a rock drilling machine. Further, when the bolting head is turnable backwards the bolt storage may be located at a front part of the carrier.

Further, present disclosure may also relate to a method of controlling boom kinematics enabled by the disclosed new boom configuration. The method according to the invention is characterized by the features and steps disclosed herein.

The above disclosed embodiments may be combined in order to form suitable solutions having those of the above features that are needed.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
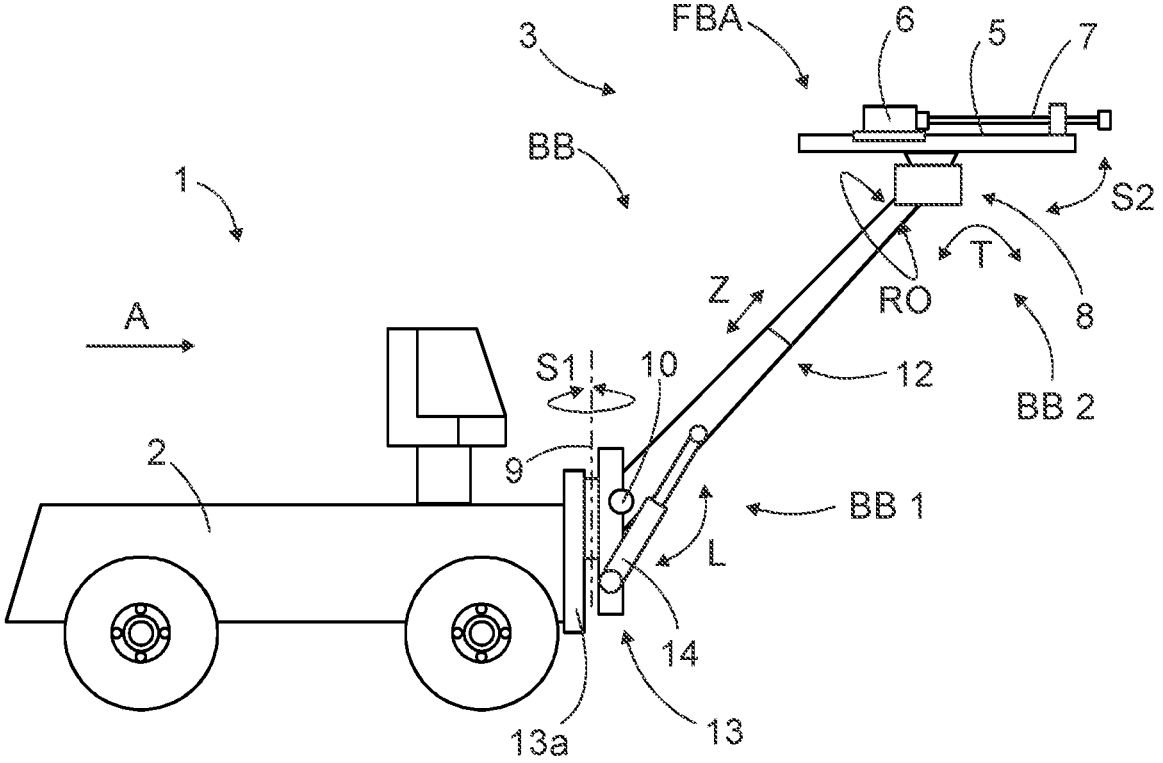
FIG. 1 is a schematic side view of a rock drilling rig for underground drilling and being provided with a drilling boom equipped with a face drilling unit.

FIG. 1 shows a rock drilling rig 1 intended for face drilling in a tunnelling process. The rock drilling rig 1 includes a movable carrier 2 and one or more drilling booms 3 connected to the carrier 2. When the drilling rig includes several drilling booms, it is typically called a drilling jumbo. The drilling boom 3 includes a basic boom part BB which is an elongated structure and a first end BB1 of which is connected movably to the carrier. At a distal second end portion of the basic boom part BB2 is a feed beam assembly FBA. The feed beam assembly FBA may include a feed beam 5 and a rock drilling machine 6 supported theron.

The rock drilling machine 6 may have a shank at a front end therof for connecting a tool 7. The feed beam assembly FBA is connected to the second end of the basic beam part BB2 by means of a front joint arrangement 8, which may be also called as a wrist. As it is shown in FIG. 1, the drilling boom 3 may have six degrees of freedom S1, L, Z, RO, T, S2 allowing the rock drilling machine 6 and the drilling tool 7 to be positioned in different drilling positions and directions.

At the first end BB1 of the basic boom part BB may be a vertical swing joint 9 so that the entire drilling boom 3 may be turned laterally, i.e. allowing first swing movement S1. The first end BB1 may further have a horizontal lift joint 10 for lifting L the drilling boom 3. The basic boom part BB may also be provided with a linear joint 12 for extending and shortening purpose. In other words, the basic boom part BB may have a so-called zoom movement Z. Thus, the basic boom part BB may have the above-mentioned three joints 9, 10 and 12.

At the first end BB1 may be a rear joint assembly 13 including a mounting plate 13*a* and the joints 9 and 10. The drilling boom 3 may be connected to the carrier 2 by means of the mounting plate 13*a* provided with fastening elements. The basic boom part BB may be without any turnable or rotational joints between the rear joint assembly 13 and the front joint assembly 8. In other words, the linear joint 12 may be the only joint between the end portions of the basic boom part BB.

Typically, the rock drilling machine 6 and actuators of the drilling boom 3 are hydraulically operable. For simplicity reasons only one boom actuator 14 is shown in FIG. 1. The boom actuators may be hydraulic cylinders, motors or other devices operating by means of hydraulic power.

The front joint arrangement 8 or wrist includes three successive joints, which are located between the second end BB2 of the basic boom BB and the feed beam assembly FBA. This means that the three successive joints are physically close to each other. The front joint arrangement 8 is thereby a compact joint system allowing roll-over movement RO, tilt movement T and swing movement S2. Respective joints of the front joint arrangement 8 are arranged in the corresponding order RO-T-S2 as it is disclosed more specifically in the following figures.

Figure 2:
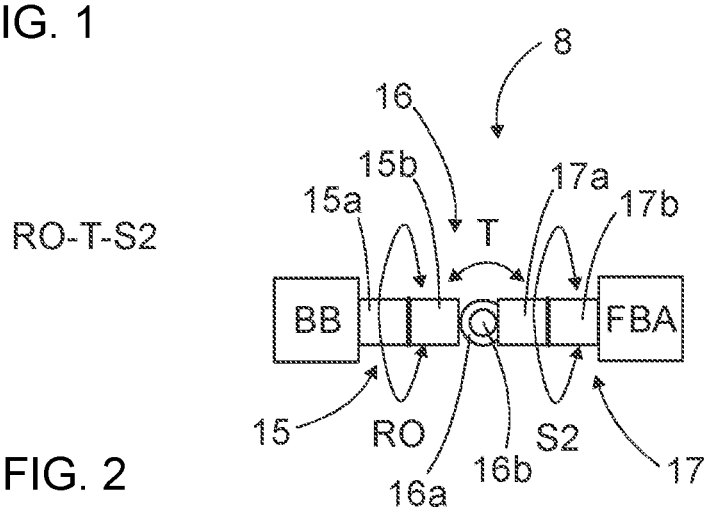
FIG. 2 is a schematic and highly simplified side view of a drilling boom and movements of the front joint assembly.

FIG. 2 shows that the wrist 8 between the basic boom part BB and the feed beam assembly FBA includes a roll over joint 15, an input link 15*a* of which is connected to the end portion of the basic boom part BB. An input link 16*a* of a feed tilt joint 16 is connected to the output link 15*b* of the roll over joint 15, and further, an input link 17*a* of a feed swing joint 17 is connected to an output link 16*b* of the feed tilt joint 16. The feed beam assembly FBA is connected to an output link 17*b* of the feed swing joint 17.

Turning axis 18 of the roll over joint 15 may be concentric with longitudinal axis 19 of the basic boom part BB. The input link 15*a* of the roll over joint 15 may be connected directly on extension of the basic boom part BB. Turning axis 20 of the following feed tilt joint 16 is perpendicular to the turning axis 18 of the roll over joint 15, and further, turning axis 21 of the feed swing joint 17 is perpendicular to the turning axis 20 of the feed tilt joint 16. The turning axis 18, 20, 21 are illustrated in FIGS. 3 and 4.

Figure 3:
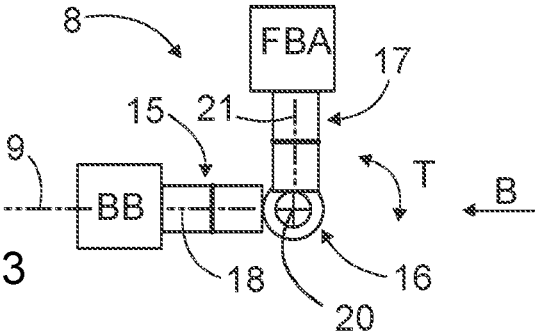
FIGS. 3 and 4 are schematic views of the drilling boom of FIG. 2 in different positions.

FIG. 3 illustrates the wrist 8 when the feed tilt joint 16 is turned 90° whereby the feed beam assembly FBA is moved above a center line of the basic beam part BB. Turning range of the feed tilt joint 16 may be at least 180° whereby the basic feed beam assembly may also be turned below the center line. The roll over joint 15 and the feed swing joint 17 may be both rotatable 360°.

Figure 4:
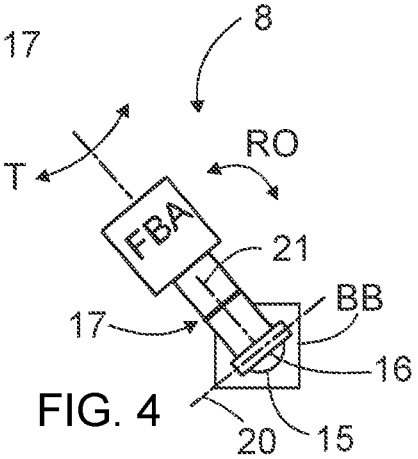

FIG. 4 shows the wrist 8 of FIG. 3 seen in a direction of an arrow B and in operational situation wherein the roll-over joint 15 has been turned for a limited angular magnitude relative to the turning axis 18.

Figure 5A:
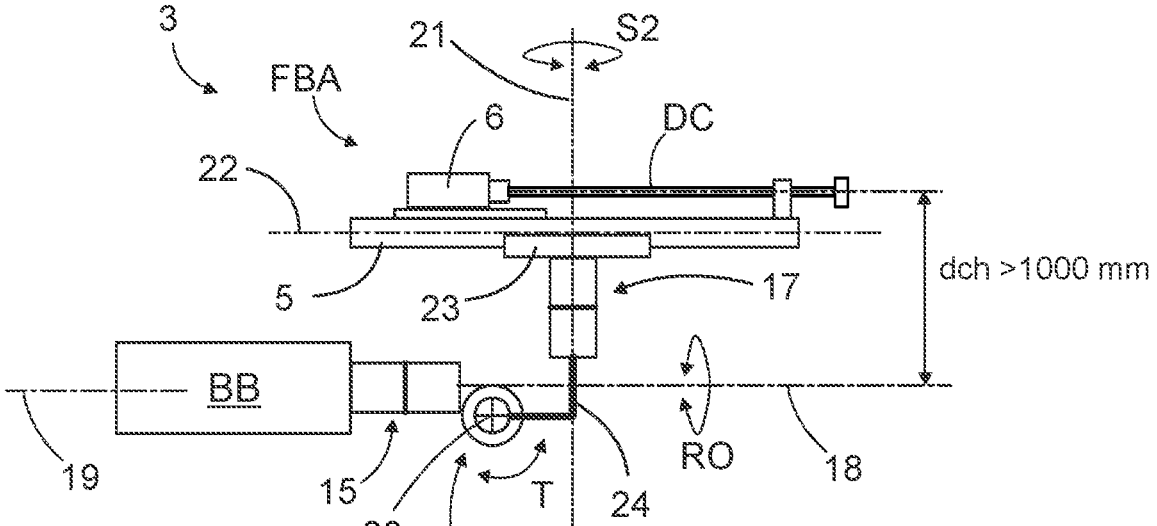
FIG. 5*a* is a schematic side view of a drilling boom intended for face drilling.

FIG. 5*a* shows a solution suitable for face drilling devices. Orientation of the feed beam 5 of the feed beam assembly FBA is perpendicular to the feed swing joint 17. Then longitudinal axis 22 of the feed beam and drilling direction of the rock drilling machine 6 are in an orthogonal direction relative to the turning axis 21 of the feed swing joint 17. The feed beam assembly FBA includes a cradle 23, which connects the the feed beam 5 and the feed swing joint 17. Further, between the feed tilt joint 16 and the feed swing joint 16 may be a connecting element 24 for providing a distance between the turning axis 20 of the feed tilt joint 16 and the turning axis 21 of the feed swing joint 17. Thus, extensions of the turning axis 20, 21 do not cross and the feed tilt joint 16 may be as close as possible to the roll-over joint 16. FIG. 5*a* shows the drilling boom 3 and its front joint assembly FBA in its normal position, whereby the feed tilt joint 16 is located vertically below the turning axis 18 of the roll-over joint 15. The feed tilt joint 16 and the feed swing joint 17 are on opposite sides of the turning axis 18 of the roll-over joint 15.

FIG. 5*a* further illustrates that a transverse drill center height dch between the drill center DC and the turning axis 18 of the roll-over joint 15 may be arranged to be at least 1,000 mm in order to improve coverage of the drilling boom 3 and to avoid collisions between the feed beam 5 and the basic boom part BB.

Figure 5B:
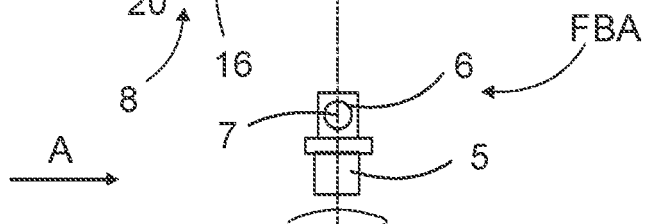
FIGS. 5*b* and 5*c* show that the drilling unit may be turned to face in cross and backward directions.

FIG. 5*b* shows in a simplified manner that the feed beam assembly FBA can be turned relative to the last joint 17 so that drilling is possible also in cross direction.

Figure 5C:
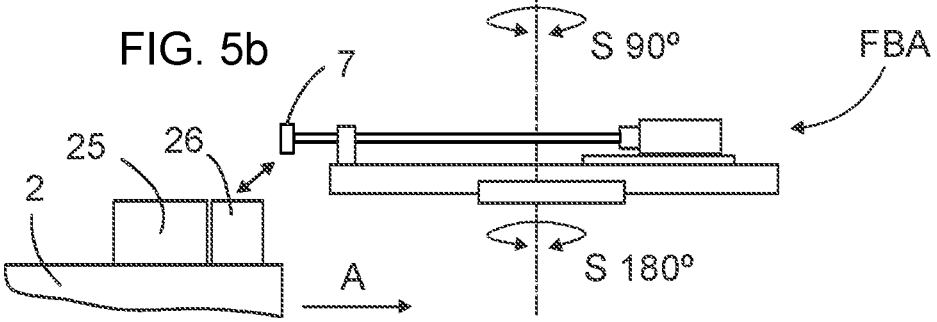

FIG. 5*c* discloses that the feed beam assembly FBA can be turned to face in a backward direction to facilitate changing of the drilling tools is facilitated. On a front portion of the carrier 2 may be a storage 25 for storing drill bits and other drilling tools. The drilling tools may be handled and changed by means of a tool handling device 26 which may also be located on the carrier 2. The drilling boom 3 may be without any tool magazine whereby the drilling boom may be lighter in weight.

Figure 6A:
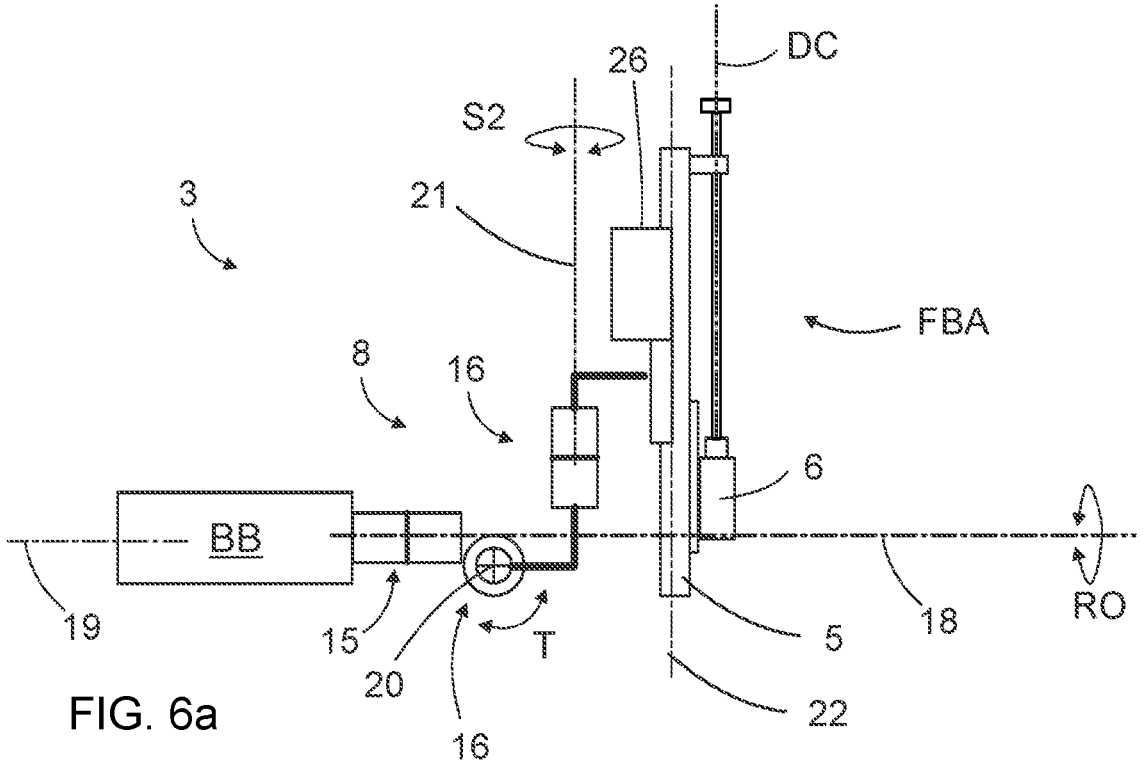
FIG. 6*a* is a schematic side view of a drilling boom intended for rock bolting purposes and FIG. 6*b* shows a principle of a face bolting option.
Figure 6B:
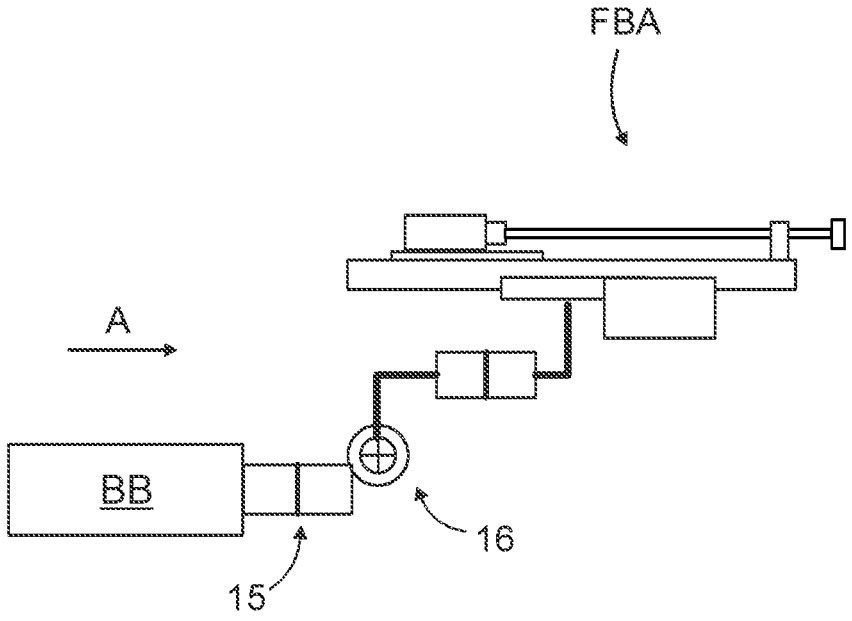

FIG. 6 discloses a rock bolting implementation of the disclosed drilling boom solution. The drilling boom 3 may have a structure which is otherwise similar than the one shown in FIG. 5*a* but in the bolting head the feed beam 5 is orientated parallel to the turning axis 21 of the feed swing joint 17. The feed beam assembly FBA may be provided with a rock bolt storage and handling device 26 for feeding rock bolts into the drilled holes. By actuating the roll-over joint 15 and the feed tilt joint 16 the feed beam assembly FBA may also be directed towards a driving surface A allowing face bolting shown in FIG. 6*b*.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A drilling boom of a rock drilling rig, the drilling boom comprising:

an elongated basic boom part having a first end movably connected to a carrier of the rock drilling rig, and a distal second end;

a feed beam assembly including at least a feed beam arranged to support a rock drilling machine, the feed beam assembly being located at the second end of the basic boom part;

a front joint arrangement located between the second end of the basic boom part and the feed beam assembly, the front joint arrangement including three successive and proximate front joints including a first front joint connected to the basic boom part, a third front joint connected to the feed beam assembly and a second front joint being located between the first and third joints; and a plurality of boom actuators arranged to move the drilling boom and the feed beam assembly, wherein the first front joint is a roll-over joint a turning axis of which is parallel to a longitudinal axis of the basic boom part, wherein the second front joint is a feed tilt joint a turning axis of which is perpendicular to the turning axis of the roll-over joint, and wherein the third front joint is a feed swing joint a turning axis of which is perpendicular to the turning axis of the feed tilt joint, wherein the roll-over joint is connected to the second end of the basic boom part and is followed by the feed tilt joint as seen in a longitudinal direction along the longitudinal axis of the basic boom part towards the feed beam assembly.

2. The drilling boom as claimed in claim 1, wherein the first end of the basic boom part is provided with a rear joint assembly including a swing joint arranged to turn the drilling boom laterally relative to the rock drilling rig and a lift joint arranged to turn the drilling boom vertically.

3. The drilling boom as claimed in claim 1, wherein the turning axis of the roll-over joint is located on the longitudinal axis of the basic boom part, whereby the turning axis and the longitudinal axis are concentric.

4. The drilling boom as claimed in claim 1, wherein the turning axis of the feed tilt joint is located closer to the roll over joint than the feed swing joint when seen in the longitudinal direction of the basic boom part.

5. The drilling boom as claimed in claim 1, wherein the feed tilt joint and the feed swing joint are located on opposite sides of the turning axis of the roll-over joint.

6. The drilling boom as claimed in claim 1, wherein orientation of the feed beam of the feed beam assembly is parallel to the turning axis of the feed swing joint.

7. The drilling boom as claimed in claim 1, wherein orientation of the feed beam of the feed beam assembly is perpendicular to the turning axis of the feed swing joint.

8. The drilling boom as claimed in claim 1, wherein the basic boom part is without any turnable or rotational joints between the first and second ends.

9. The drilling boom as claimed in claim 1, wherein the front joint arrangement has a symmetric structure relative to the longitudinal axis of the basic boom part, whereby the drilling boom is implementable either as a left or a right hand boom of the rock drilling rig.

10. The drilling boom as claimed in claim 1, wherein the boom actuators are hydraulic actuators.

11. A rock drilling rig comprising:

a movable carrier;

at least one drilling boom in accordance with claim 1, the at least one drilling boom being connected movably to the carrier and equipped with a feed beam assembly with a feed beam; and a rock drilling machine supported by the feed beam, wherein the at least one drilling boom includes a plurality of boom joints and boom actuators arranged for orientating and positioning a drilling tool connectable to the rock drilling machine to drilling points at a drilling site.

12. The rock drilling rig as claimed in claim 11, wherein the rock drilling machine defines a drill center which is parallel to the longitudinal direction of the feed beam and on which drill center a drilling tool is rotated during drilling, the drill center having a drill center height which is a transverse distance measured to the turning axis of the roll-over joint, wherein the drill center height is at least 1,000 mm.

* * * * *